US009265138B2

(12) United States Patent
Hammer et al.

(10) Patent No.: US 9,265,138 B2
(45) Date of Patent: Feb. 16, 2016

(54) ELECTROMAGNETIC WAVEGUIDE AND PLASMA SOURCE

(71) Applicant: AGILENT TECHNOLOGIES, INC., Loveland, CO (US)

(72) Inventors: Michael Ron Hammer, Sassafras (AU); John Pillans, Melbourne (AU); Thomas Erwin Preuss, North Fitzroy (AU)

(73) Assignee: Agilent Technologies, Inc., Santa Clara, CA (US)

( * ) Notice: Subject to any disclaimer, the term of this patent is extended or adjusted under 35 U.S.C. 154(b) by 247 days.

(21) Appl. No.: 13/955,193

(22) Filed: Jul. 31, 2013

(65) Prior Publication Data

US 2014/0062299 A1 Mar. 6, 2014

Related U.S. Application Data

(60) Provisional application No. 61/693,882, filed on Aug. 28, 2012.

(51) Int. Cl.
*H01J 17/04* (2012.01)
*H05H 1/30* (2006.01)

(52) U.S. Cl.
CPC ..... *H05H 1/30* (2013.01)

(58) Field of Classification Search
USPC ..... 315/32–76
See application file for complete search history.

(56) References Cited

U.S. PATENT DOCUMENTS

| | | | | |
|---|---|---|---|---|
| 3,280,364 | A | 10/1966 | Sugawara et al. | |
| 4,473,736 | A | 9/1984 | Bloyet et al. | |
| 5,734,143 | A | 3/1998 | Kawase et al. | |
| 5,847,355 | A | 12/1998 | Barmatz et al. | |
| 6,683,272 | B2 * | 1/2004 | Hammer | 219/121.48 |
| 7,030,979 | B2 | 4/2006 | Hammer | |
| 7,371,992 | B2 | 5/2008 | Carr | |
| 2003/0111445 | A1 * | 6/2003 | Hammer | 219/121.48 |
| 2005/0078309 | A1 * | 4/2005 | Hammer | 356/316 |

FOREIGN PATENT DOCUMENTS

| | | |
|---|---|---|
| DE | 4004560 | 8/1990 |
| DE | 60103178 | 4/2005 |
| JP | 06005384 | 1/1994 |
| WO | WO0060910 | 10/2000 |

OTHER PUBLICATIONS

Jankowski, et al. "Microwave Induced Plasma Analytical Spectrometry", Royal Society of Chemistry, Cambridge, UK 2010, p. 75-76.
Machine translation of JP06005384.
Machine translation of DE4004560.
Machine translation of DE60103178.

(Continued)

*Primary Examiner* — Brandon S Cole

(57) ABSTRACT

A method comprises: aligning a plasma torch within an iris cavity of an iris along a first axis between first and second iris slots having heights less than 70% of the diameter of the torch; and generating an electromagnetic field having field lines along a second axis. The field comprises a component that is substantially transverse to the first direction. An apparatus is also described.

27 Claims, 6 Drawing Sheets

(56) References Cited

OTHER PUBLICATIONS

Office Action mailed Feb. 19, 2015 in German Patent Application No. 10 2013 214 686.8 (Unofficial/Non-certified translation provided by foreign agent included).

Smiljanic, et al. "Gas-phase synthesis of SWNT by an atmospheric pressure plasma jet", Chemical Physics Letters 356 (2002) 189-193.

* cited by examiner

ELECTROMAGNETIC WAVEGUIDE AND PLASMA SOURCE

CROSS-REFERENCE TO RELATED APPLICATIONS

The present application claims priority under 35 U.S.C. §119(e) from U.S. Provisional Patent Application No. 61/693,882 filed on Aug. 28, 2012, and naming Michael R. Hammer, et al. as inventors. The entire disclosure of the referenced U.S. Provisional Patent Application No. 61/693,882 is specifically incorporated herein by reference.

BACKGROUND

Plasma sources for spectrochemical analysis sometimes include a plasma torch coupled to an electromagnetic waveguide so that electromagnetic radiation (e.g., microwave radiation) can be used to generate and sustain the plasma.

One known type of plasma source includes a waveguide so oriented that the magnetic field of the electromagnetic radiation is oriented along a common axis of the plasma torch, and the magnetic field strength is at a maximum at the position of the plasma torch. This type of plasma source ideally establishes a plasma having a circular or elliptical cross-section, and with a slightly less dense (cooler) plasma along the axial dimension.

While that known plasma source provided significant improvement over other known plasma sources, the performance of the plasma source was found to be compromised if the length of the waveguide deviated even by small amounts from the optimum. Notably, minor variations in the length of the waveguide, as can be expected to occur in a routine manufacturing environment, were found to result in the establishment of undesirable asymmetric plasmas, that adversely affect the analytical performance of the plasma source.

There is therefore a need to provide an improved electromagnetic waveguide and plasma source that overcomes at least the shortcomings of the known waveguides and plasma sources described above.

SUMMARY

In a representative embodiment, an apparatus comprises: an electromagnetic waveguide having a length and height; a first iris slot crossing the waveguide at a first position along the length of the waveguide having a height less than that of the waveguide; a second iris slot crossing the waveguide at a second position along the length of the waveguide having a height less than that of the waveguide; and a plasma torch having a longitudinal axis crossing the waveguide at a position between the first and second iris slots. The first iris slot and the second iris slot are configured to transmit electromagnetic fields substantially transverse to the longitudinal axis of the plasma torch to excite plasma in the plasma torch. Additionally, the heights of the first iris slot and the second iris slot are less than 70% of the diameter of the torch.

In another representative embodiment a method comprises: aligning a plasma torch within an iris cavity of an iris along a first axis between first and second iris slots having heights less than 70% of the diameter of the torch; and generating an electromagnetic field having field lines along a second axis. The field comprises a component that is substantially transverse to the first direction.

BRIEF DESCRIPTION OF THE DRAWINGS

The representative embodiments are best understood from the following detailed description when read with the accompanying drawing figures. Wherever applicable and practical, like reference numerals refer to like elements.

DETAILED DESCRIPTION

Figure 1A:
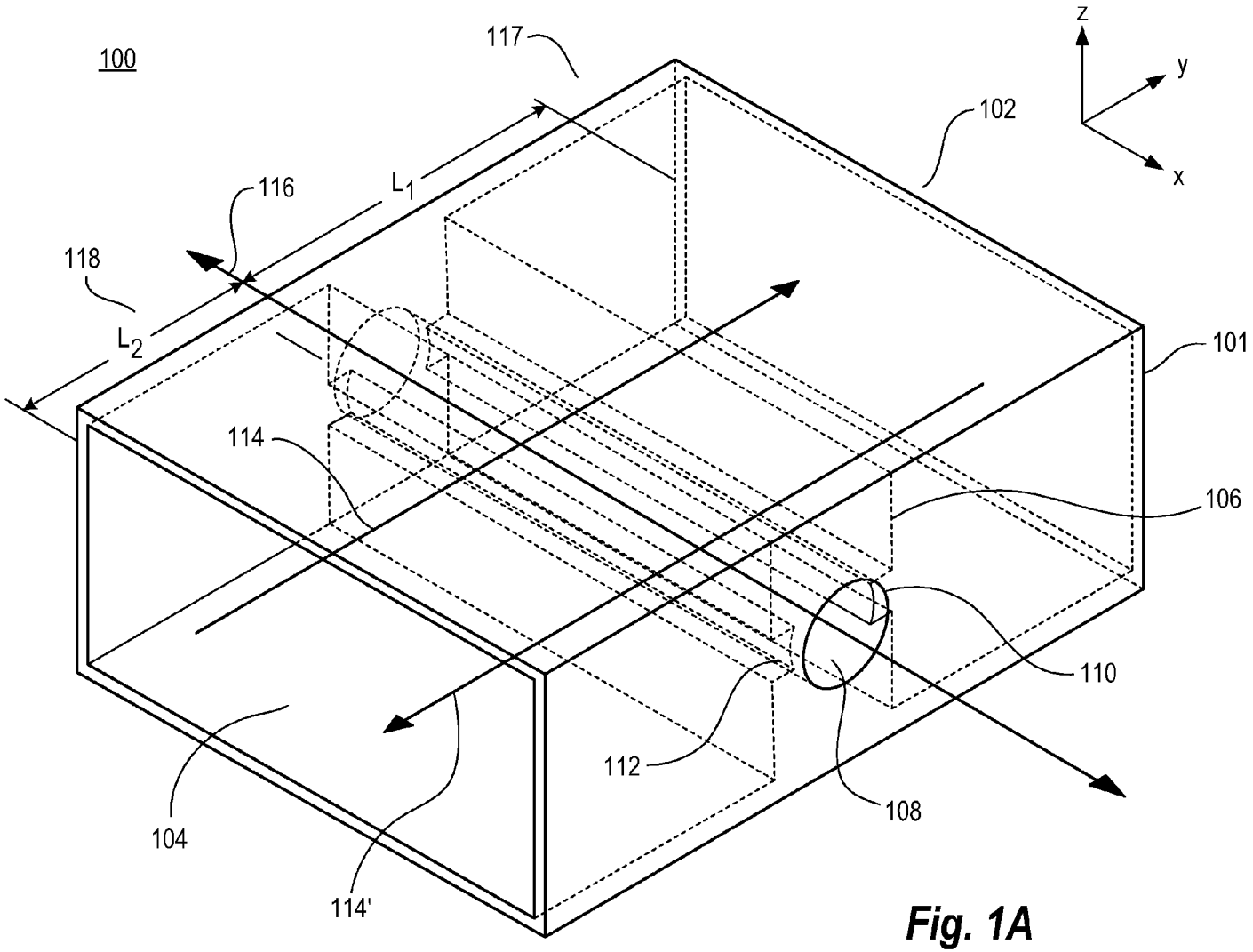
FIG. 1A is a perspective view of an apparatus according to a representative embodiment.

In the following detailed description, for purposes of explanation and not limitation, illustrative embodiments disclosing specific details are set forth in order to provide a thorough understanding of embodiments according to the present teachings. However, it will be apparent to one having had the benefit of the present disclosure that other embodiments according to the present teachings that depart from the specific details disclosed herein remain within the scope of the appended claims. Moreover, descriptions of well-known devices and methods may be omitted so as not to obscure the description of the example embodiments. Such methods and devices are within the scope of the present teachings.

Generally, it is understood that as used in the specification and appended claims, the terms "a", "an" and "the" include both singular and plural referents, unless the context clearly dictates otherwise. Thus, for example, "a device" includes one device and plural devices.

As used in the specification and appended claims, and in addition to their ordinary meanings, the terms "substantial" or "substantially" mean to within acceptable limits or degree. For example, "substantially cancelled" means that one skilled in the art would consider the cancellation to be acceptable. As a further example, "substantially removed" means that one skilled in the art would consider the removal to be acceptable.

As used in the specification and the appended claims and in addition to its ordinary meaning, the term "approximately" means to within an acceptable limit or amount to one having ordinary skill in the art. For example, "approximately the same" means that one of ordinary skill in the art would consider the items being compared to be the same.

The present teachings relate generally to a waveguide useful in combination with a plasma torch to generate and sustain a plasma useful in spectrochemical analysis. Generally, the waveguide includes an iris into which a plasma torch is disposed. The waveguide (without the iris) is configured to support the desired mode (e.g., $TE_{10}$). The iris presents an impedance mismatch (a perturbation) that alters the shape of the field pattern, as described more fully below. As should become clearer as the present description continues, according to the present teachings, the mode supported in the waveguide is selected so that the dominant electromagnetic field in an iris cavity is transverse to a center (longitudinal) axis of the plasma torch. This is the opposite of the intention of known devices such as those disclosed in commonly owned U.S. Pat. No. 6,683,272 to Hammer, in which it is intended to generate a field parallel to a center axis of the plasma torch. As such, electromagnetic field lines established in the iris are substantially transverse to an axis through the center of a cavity in the iris. The length of the waveguide relative to the cavity of the iris is selected so as to establish the center of the electromagnetic field loop at the iris position. In certain representative embodiments described below, the center of the electromagnetic loop is selected to be an odd-multiple of the quarter wavelength n(λ/4) of this mode. Beneficially, the resultant plasma has a substantially circular cross-section with a comparatively "hot" perimeter and a cooler center.

FIG. 1A is an isometric view of an apparatus 100 in accordance with a representative embodiment. The apparatus 100 comprises an electromagnetic waveguide ("waveguide") 101 in the representative embodiments described below. The waveguide 101 is configured to support a desired propagation mode ("mode") at a frequency suitable for generating and sustaining a plasma. Beneficially, the desired mode supported by the waveguide 101 provides electromagnetic field lines oriented in a direction that is substantially orthogonal or transverse to an axis of orientation of a plasma torch, as will be described more fully below. Furthermore, and as will become clearer as the present description continues, the desired modes are selected to generate and sustain a plasma that is also substantially symmetric about an axis.

Illustratively, the waveguide 101 is configured to support a $TE_{10}$ mode having a frequency in the microwave portion of the electromagnetic spectrum. For example, the selected mode may have a characteristic frequency of approximately 2.45 GHz. Certain illustrations of dimension described below are based on this illustrative frequency of the desired mode. Notably, however, the embodiments described herein are not limited to operation in the microwave spectrum, and certainly not limited to operation at 2.45 GHz. In particular, because the operational frequency range selected dictates the wavelength of the selected mode(s) of operation and the operational wavelengths are primarily limited by the geometric sizes of the torch and waveguide 101, the operational frequency is also limited by the geometric size of the plasma torch and waveguide 101. Illustratively, the present teachings can be readily implemented to include operational frequencies both higher and lower and in the range of approximately 5.8 GHz or approximately 24.125 GHz. Furthermore, the desired mode is not limited to the illustrative $TE_{10}$, and the waveguide 101 (or first and/or second portions 117, 118 depicted in FIG. 1A) is not necessarily rectangular in dimension. Rather, as noted above, the modes are selected to provide electromagnetic field tines that are transverse to the axis of orientation of the plasma torch. Such modes, or waveguide shapes, or both, that support this desired orientation of electromagnetic field tines are contemplated by the present teachings.

The waveguide 101 is short-circuited at a first end 102 and is adjacent to a source of microwave energy (not shown) disposed at a second end 104. An iris 106 is disposed in the waveguide 101 and comprises an iris cavity 108 with a first iris slot 110 disposed along one side of the iris cavity 108 and a second iris slot 112 disposed on an opposing side of the iris cavity 108. The inventors have discovered that the height of the first iris slot 110 should be less than 70% of the diameter of the plasma torch. Similarly, the height of second iris slot 112 should be less than 70% of the diameter of the plasma torch. As noted above, and as described more fully below, in representative embodiments the center of the iris 106 (e.g. at second axis 116) is disposed at a distance (represented as a first length L1 in FIG. 1A) substantially an odd-multiple of the quarter wavelength n(λ/4) of a desired mode of the waveguide 101 from one end (e.g., first end 102). Moreover, in a representative embodiment, the center of the iris 106 (e.g. at second axis 116) is disposed a distance (represented as a second length L2 in FIG. 1A) greater than one-half wavelength (λ/2) of the desired mode from the other end (e.g., second end 104) of the waveguide 101. As such, the iris 106 is positioned between a first portion 117 of the waveguide 101 and a second portion 118 of the waveguide 101. Notably, the waveguide 101 may be a single piece comprising first and second portions 117, 118 with the iris 106 positioned therein. Alternatively, the waveguide 101 may comprise two separate pieces (e.g., first and second portions 117, 118 being separate pieces) with the iris 106 positioned therebetween.

Illustratively, the center (at second axis 116) of the iris cavity 108 is located 55 mm from the first end 102, the first and second iris slots 110, 112 in the iris 106 are each 6 mm high (z dimension in the coordinate system of FIG. 1) by 50 mm wide (x-dimension the coordinates system of FIG. 1), and the iris cavity 108 has a diameter of 13 mm diameter. The distance to the magnetron source of microwaves to the iris 106 is selected to minimize the reflections from the iris 106, plasma torch (not shown in FIG. 1) and optimize the efficiency of transfer of microwave power from the microwave source to the plasma. As noted above, in one implementation of the representative embodiment, the center of the iris 106 (e.g., at second axis 116) is disposed a distance greater than one-half wavelength (λ/2) of the desired mode from the second end 104, which is adjacent to the source of electromagnetic radiation. It is noted that the dimensions presented are merely illustrative, and are dictated by the selection of the frequency/wavelength of the selected mode.

The various components of the apparatus 100 are made of a suitable electrically conductive material, such as a metal (e.g. aluminum) or metal alloy suitable for use at the selected frequency of operation of the apparatus 100. Certain aspects of the waveguide 101 and the iris 106 are common to the iris described in commonly owned U.S. Pat. No. 6,683,272 to Hammer. The disclosure of this patent is specifically incorporated by reference herein.

As described more fully below, a plasma torch (not shown in FIG. 1A) is positioned inside the iris cavity 108 to contain and shape the plasma generated. In a representative embodiment, the first length $L_1$ of the section of the apparatus 100 from the first end 102 to the center (i.e., the second axis 116) of the iris cavity 108 is illustratively approximately an odd-multiple of one-quarter wavelength (λ/4) of the desired mode, although beneficially, there is a considerable latitude in this dimension, and the first length $L_1$ is typically from approximately 0.15 wavelengths of the desired mode to approximately 0.35 wavelengths of the desired mode. A transverse electromagnetic field is located in the first and second iris slots 110, 112 in the iris 106 and in the iris cavity 108. By placing a plasma torch in the iris cavity 108, substantially transverse electromagnetic excitation of a plasma-forming gas supplied to the plasma torch can be readily achieved.

Beneficially, however, the precision of the first length $L_1$ is not as critical to the overall shape of the plasma formed and to the performance of the plasma source comprising the apparatus 100 as it is in certain known structures. Rather, and as alluded to above, the selected mode is supported in an unperturbed waveguide 101. However, the iris 106 presents a perturbation that alters the wavelength and shape of the mode in the waveguide 101. The plasma generated and sustained according to the present teachings results from the perturbation, and the alteration of the shape of the field pattern provides tolerance in the first length $L_1$ of the waveguide 101. Accordingly, by virtue of the structure of the waveguide 101 and the iris 106 including the first and second iris slots 110, 112, the electromagnetic field remains substantially transverse to the axis (e.g., second axis 116) of the plasma torch in spite of the variation of the first length $L_1$, enabling plasma to be generated and sustained in a desired shape. As such, the mode supported in the waveguide 101 is selected so that the dominant electromagnetic field in an iris cavity 108 is transverse to a center axis of the plasma torch.

Illustratively, the iris cavity 108 is cylindrically shaped to accommodate the plasma torch, which typically comprises at least two (and typically three) concentric tubes (an outer tube and two concentric inner tubes) of a non-conducting material such as quartz or ceramic providing two or more (i.e., typically three) separate gas flows. The concentric tubes of the plasma torch (not shown) share a common central axis, which in the representative embodiment depicted in FIG. 1A would be oriented parallel to the second axis 116*k* carrier gas with entrained sample normally flows through the innermost tube and a separate plasma-sustaining and torch-cooling gas flows in the gap between the two tubes. Illustratively the plasma-sustaining and torch-cooling gas is nitrogen, and arrangements are provided for producing a flow of this gas conducive to forming a stable plasma having a substantially hollow core, and to keeping the plasma sufficiently isolated from any part of the torch so that no part of the torch is overheated. For example the plasma-sustaining gas may be injected radially off-axis so that the flow spirals. This gas flow sustains the plasma and the analytical sample carried in the inner gas flow is heated by radiation and conduction from the plasma, as is well-known in the art. For the purpose of initially igniting the plasma, the plasma-sustaining and torch-cooling gas flow may temporarily and briefly be changed from nitrogen to argon. An example of a suitable plasma torch is described in detail in commonly owned U.S. Pat. No. 7,030,979 to Hammer. The disclosure of this patent is specifically incorporated herein by reference.

Figure 1B:
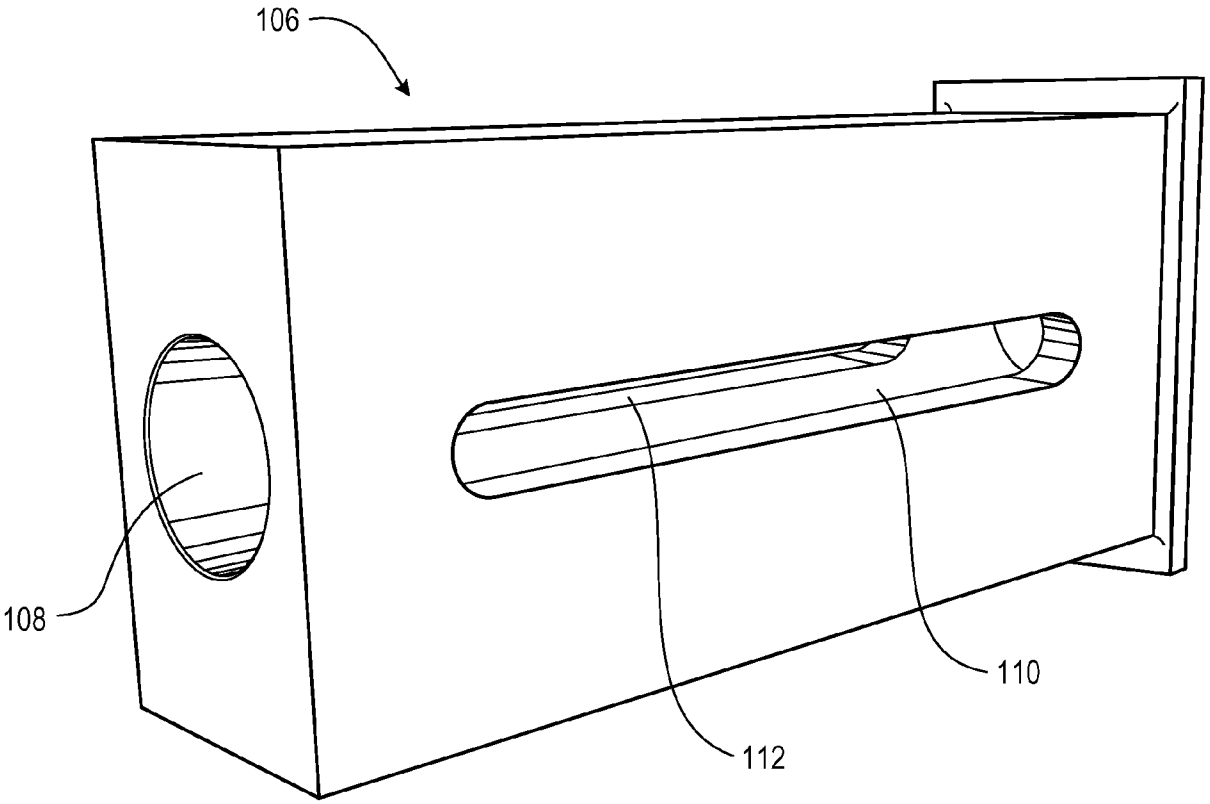
FIG. 1B is a perspective view of an iris in accordance with a representative embodiment.

FIG. 1B is a perspective view of an iris 106 in accordance with a representative embodiment. The iris 106 comprises iris cavity 108, first iris slot 110 and second iris slot 112. As described herein, the iris 106 is disposed in the waveguide 101 so that the center of the iris cavity 108 (i.e., at second axis 116) is disposed from an end (e.g., first end 102 or second end 104) of the iris cavity 108 to establish the electromagnetic field so that transverse electromagnetic excitation of a plasma-forming gas supplied to the plasma torch can be readily achieved. As noted above, the distance from the center of the iris cavity 108 (i.e., the second axis 116) to an end of the waveguide 101 is illustratively approximately an odd-multiple of one-quarter wavelength ($\lambda/4$) of the desired mode.

Figure 2:
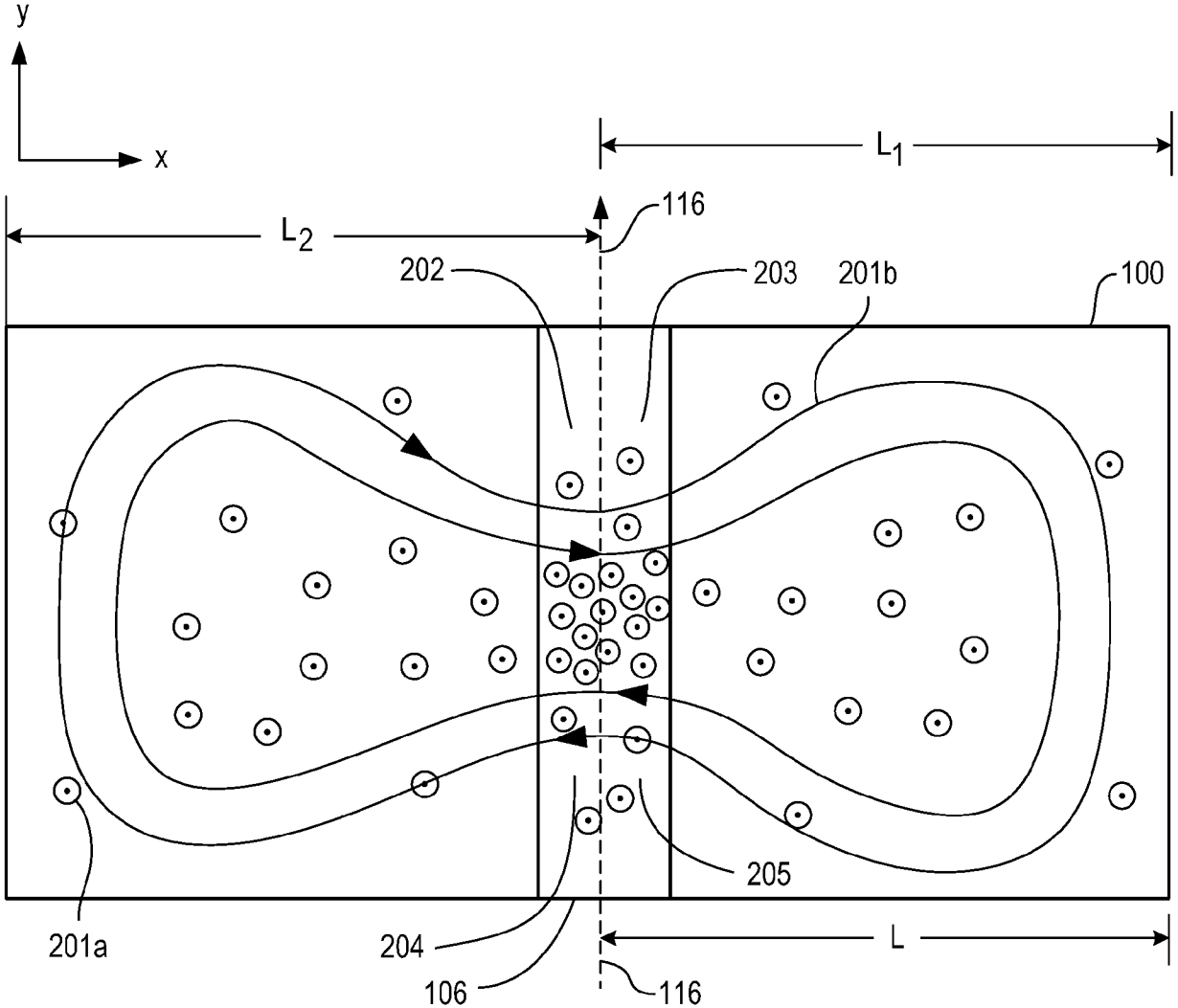
FIG. 2 is a top view depicting electromagnetic field lines of a mode supported in the waveguide according to a representative embodiment.

FIG. 2 is a top view depicting electromagnetic field lines 201*a, b* (electric field lines 201*a* and magnetic field lines 201*b*) of a desired mode supported in the apparatus 100 according to a representative embodiment. The electromagnetic field lines 201*a, b* of the mode are substantially transverse to the second axis 116 at the center of the iris cavity 108 of the iris 106. Length L is selected to be approximately odd-multiples of one-quarter wavelength ($\lambda/4$) of the desired mode results in electromagnetic field minima at the location of the plasma torch (not shown in FIG. 2) in the iris cavity 108.

As noted above, the propagation mode of the unperturbed waveguide 101 (i.e., without iris 106) has a certain shape (not shown). The shape of the mode is altered by the perturbation resulting from the iris 106, but the electromagnetic field lines 201*a, b* of the mode in the iris 106 remain substantially transverse. In contrast to a known waveguide in which the magnetic field lines are purposefully oriented in an axial direction relative to the iris and plasma torch, the effectiveness of the new waveguide structure is not critically dependent on its physical dimensions. In the known waveguide there is little (if any) room for error. Thus, in the known waveguide structure, variation of the dimensions of the elements of the waveguide, or variation in their placement, or both can have a significant and undesired impact on the orientation and position of the electromagnetic field lines 201*a, b* relative to the plasma torch, and on the resultant plasma. As can be appreciated from a review of FIG. 2, slight variations in the placement of the iris 106, especially in the x-dimension of the coordinate system of FIG. 2, will have little if any impact on the orientation of the electromagnetic field lines 201*a, b* relative to the plasma torch. Specifically, a slight misplacement of the iris 106 in the x-direction may result in a variation of the length L from the desired odd-multiple of one-quarter wavelength of the waveguide 101, but the electromagnetic field lines 201*a, b* remain desirably substantially transverse to the second axis 116 and thus the plasma torch.

As described more fully below in connection with FIG. 3, the electromagnetic field distribution realized by a representative embodiment results in the formation of four substantially crescent-shaped lobes of plasma in regions 202, 203 and 204, 205. These crescent-shaped lobes of plasma result in a composite plasma in the iris 106 disposed symmetrically about the second axis 116 in the regions 202, 203 and 204, 205. Each of these composite plasmas has a substantially hollow cylindrical shape, and each comprises hot plasma around its perimeter and a cooler central core.

Figure 3:
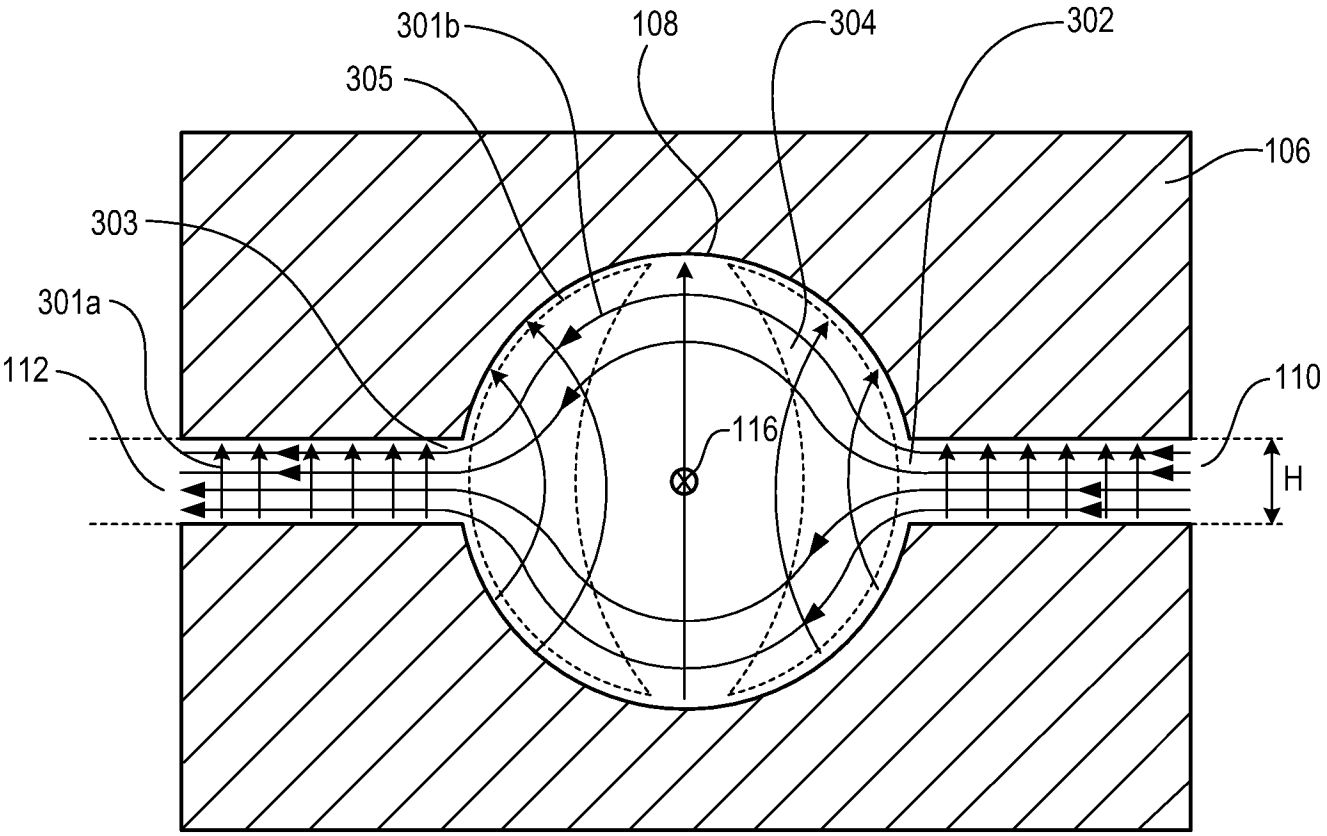
FIG. 3 is a side view depicting electromagnetic field lines of a desired mode in the regions of a cavity in an iris according to a representative embodiment.

FIG. 3 is a side view of the iris 106 viewed down the second axis 116. Electromagnetic field lines 301*a, b* (electric field lines 301*a* and magnetic field lines 301*h*) of a desired mode are disposed in the regions of the cavity 103 and first and second iris slots 110, 112 of the iris 106. The first and second iris slots 110, 112 each have a height "H" as depicted in FIG. 3. Transverse electromagnetic fields 301*a, b* generate and sustain first and second crescent-shaped plasmas 304, 305 having greater power ("hotter") in first and second regions 302, 303. By contrast, little if any current is generated, and little if any plasma is sustained in the center of the iris cavity 108.

In combination, the first and second crescent-shaped plasmas 304, 305 create a single plasma having a substantially hollow cylindrical shape having hot plasma around its perimeter with a cooler central core. Finally, as alluded to above, in representative embodiments, a second set of crescent shaped plasmas (not shown) are formed and sustained at another location along the second axis 116 (e.g., in regions 202, 203 depicted in FIG. 2). Like first and second crescent-shaped plasmas 304, 305, these crescent shaped plasmas are substantially symmetric about the second axis 116 and form a single plasma having a substantially hollow cylindrical shape having hot plasma around its perimeter with a cooler central core.

Figure 4:
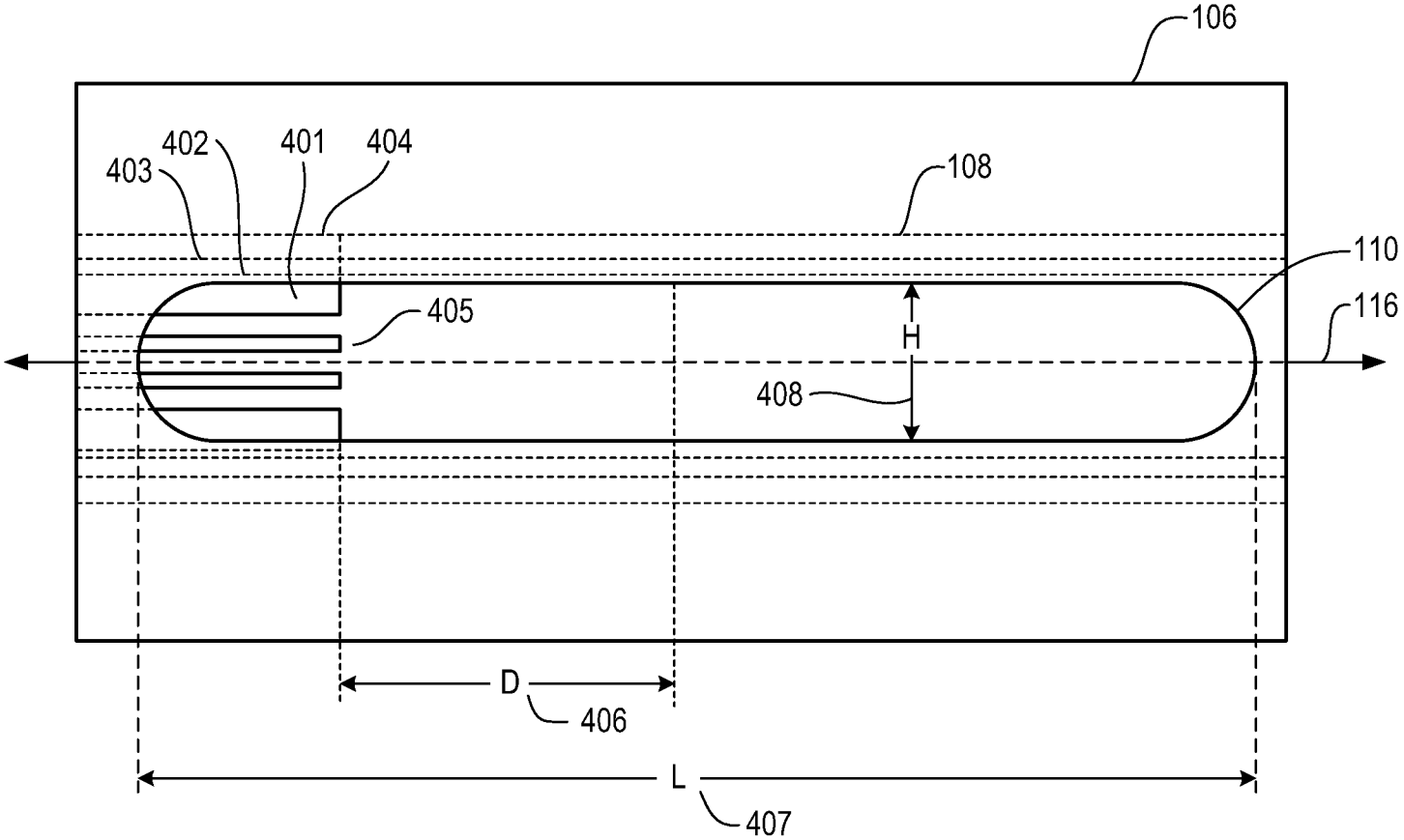
FIG. 4 is a side view of the iris according to a representative embodiment.

FIG. 4 is a side view of the iris 106 in accordance with a representative embodiment. Many details of the iris 106 are common to those presented above in the description of illustrative embodiments, and generally are not repeated. Moreover, in view of the symmetry of the iris 106, the description of the second iris slot 112 is virtually identical to the present description of the first iris slot 110.

A plasma torch 401 (see FIG. 4) is disposed in the iris cavity 108 of the iris 106, and has concentric cylinders 402, 403, 404, which supply the central gas flow, an intermediate gas flow and a plasma-sustaining and torch-cooling gas flow in the plasma torch 401. The plasma torch 401 includes a tip 405, which is located a distance "D" 406 from the center line of the first iris slot 110 as depicted in FIG. 4. Moreover, the first iris slot 110 has a length "L" 407 and a height "H" 408.

As noted above, the height 408 of the first iris slot 110 is selected to provide confinement of the electromagnetic field of the desired mode for generating and sustaining the plasma. This confinement of the electromagnetic field results in the desired field gradients that ultimately produce a substantially symmetric plasma. The height 408 and other dimensions of the apparatus 100 depend on the wavelength of the desired mode for generating and sustaining the plasma. Illustratively, the height 408 is approximately 6 mm to approximately 8 mm for a 2.4 GHz mode in the apparatus 100 and will in general be less than 70% of the diameter of the plasma torch.

Figure 5:
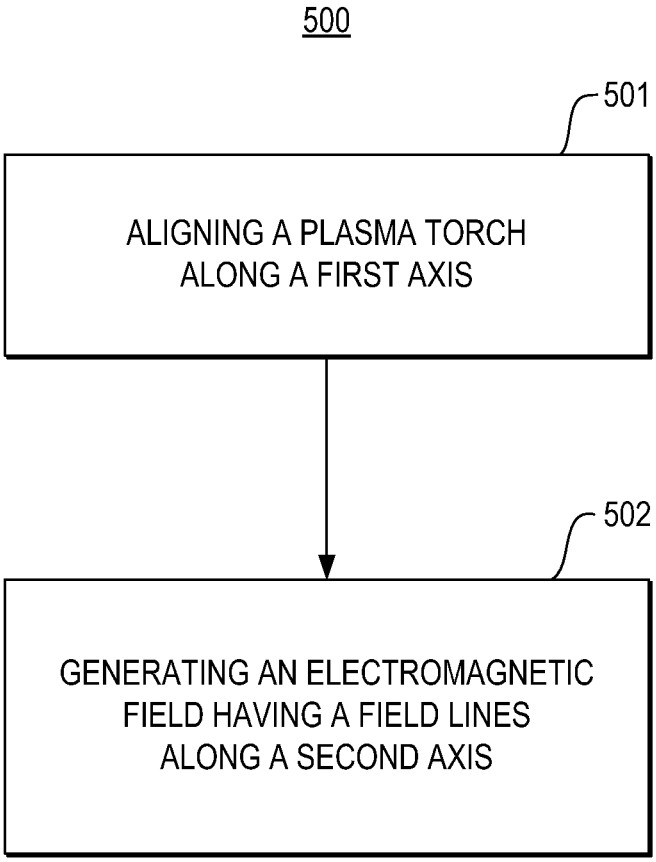
FIG. 5 is a flow chart of a method of producing a plasma, according to a representative embodiment.

FIG. 5 is a flow chart of a method 500 of producing a plasma, according to a representative embodiment. At 501, the method 500 comprises aligning a plasma, torch along a first axis. At 502, the method 500 comprises generating an electromagnetic field having field lines along a second axis.

In accordance with illustrative embodiments, an electromagnetic waveguide and plasma source comprising the electromagnetic waveguide are described. One of ordinary skill in the art appreciates that many variations that are in accordance with the present teachings are possible and remain within the scope of the appended claims. These and other variations would become clear to one of ordinary skill in the art after inspection of the specification, drawings and claims herein. The invention therefore is not to be restricted except within the spirit and scope of the appended claims.

What is claimed is:

1. An apparatus, comprising:

an electromagnetic waveguide having a length and height;

a first iris slot crossing the waveguide at a first position along the length of the waveguide having a height less than that of the waveguide;

a second iris slot crossing the waveguide at a second position along the length of the waveguide having a height less than that of the waveguide; and a plasma torch having a longitudinal axis crossing the waveguide at a position between the first and second iris slots;

wherein the first iris slot and the second iris slot are configured to transmit electromagnetic fields substantially transverse to the longitudinal axis of the plasma torch to excite plasma in the plasma torch; and wherein the heights of the first iris slot and the second iris slot are less than 70% of the diameter of the torch.

2. The apparatus of claim 1, wherein the electromagnetic fields are substantially standing waves transverse to the longitudinal axis of the plasma torch.

3. The apparatus of claim 1, wherein the electromagnetic fields pass by the longitudinal axis of the plasma torch as substantially traveling waves transverse to the longitudinal axis.

4. The apparatus of claim 1, further comprising an iris cavity disposed between the first iris slot and the second iris slot.

5. The apparatus of claim 4, wherein the plasma torch has a tip disposed in the cavity.

6. The apparatus of claim 4, wherein the plasma is generated in the cavity substantially symmetrically around the longitudinal axis of the plasma torch.

7. The apparatus of claim 4, wherein the plasma has a first substantially crescent shaped lobe and a second substantially crescent shaped lobe disposed on opposing sides of the cavity.

8. The apparatus of claim 7, further comprising another plasma disposed an axial distance away from the plasma, wherein the other plasma has a first substantially crescent shaped lobe and a second substantially crescent shaped lobe disposed on opposing sides of the cavity.

9. The apparatus of claim 8, wherein, for each of the plasma and the other plasma, the first and second crescent shaped lobes are substantially symmetric about the first axis.

10. The apparatus of claim 1, wherein the length from an end of the electromagnetic waveguide to a center of the iris is substantially equal to or greater than approximately an odd-multiple of one-quarter wavelength ($\lambda/4$) of an electromagnetic propagation mode.

11. The apparatus of claim 10, wherein the end of the electromagnetic waveguide is electrically connected to ground.

12. The apparatus of claim 1, wherein the length from an end of the electromagnetic waveguide to a center of the iris is greater than approximately one-half wavelength ($\lambda/2$) of an electromagnetic propagation mode.

13. The apparatus of claim 12, wherein the end of the electromagnetic waveguide is electrically coupled to a source of electromagnetic radiation.

14. The apparatus of claim 1, wherein the electromagnetic fields include electric fields substantially transverse to the longitudinal axis of the plasma torch and wherein the electric fields excite the plasma in the plasma torch.

15. The apparatus of claim 1, wherein the electromagnetic fields include magnetic fields substantially transverse to the longitudinal axis of the plasma torch and wherein the magnetic fields excite the plasma in the plasma torch.

16. The apparatus of claim 1, wherein the length from an end of the electromagnetic waveguide to a center of the iris is substantially equal to an odd-multiple of one-quarter wavelength ($\lambda/4$) of an electromagnetic propagation mode.

17. A method of producing a plasma, the method comprising:

aligning a plasma torch within an iris cavity of an iris along a first axis between first and second iris slots having heights less than 70% of the diameter of the torch; and generating an electromagnetic field having field lines along a second axis, wherein the field comprises a component that is substantially transverse to the first axis.

18. The method of claim 17, wherein the method further comprises:

providing a plasma forming gas to the plasma torch;

applying electromagnetic power to establish the electromagnetic field; and generating a plasma.

19. The method of claim 18, wherein the electromagnetic power is established in an electromagnetic waveguide disposed adjacent to the iris.

20. The method of claim 19, wherein the length from an end of the electromagnetic waveguide to a center of the iris is substantially equal to or greater than approximately an odd-multiple of one-quarter wavelength ($\lambda/4$) of an electromagnetic propagation mode.

21. The method of claim 20, wherein the length from an end of the electromagnetic waveguide to a center of the iris is greater than approximately one-half wavelength ($\lambda/2$) of an electromagnetic propagation mode.

22. The method of claim 18, wherein the plasma has a first substantially crescent shaped lobe and a second substantially crescent shaped lobe disposed on opposing sides of the cavity.

23. The method of claim 22, further comprising generating another plasma disposed an axial distance away from the plasma, wherein the other plasma has a first substantially crescent shaped lobe and a second substantially crescent shaped lobe disposed on opposing sides of the cavity.

24. The method of claim 22, wherein the first and second crescent shaped lobes are substantially symmetric about the first axis.

25. The method of claim 18, wherein the electromagnetic field includes an electric field substantially transverse to the longitudinal axis of the plasma torch and wherein the electric field excites the plasma in the plasma torch.

26. The method of claim 18, wherein the electromagnetic field includes a magnetic field substantially transverse to the longitudinal axis of the plasma torch and wherein the magnetic field excites the plasma in the plasma torch.

27. The method of claim 18, wherein the plasma is generated in the cavity substantially symmetrically around the first axis.

* * * * *